US005683048A

United States Patent [19]

Virving

[11] Patent Number: 5,683,048

[45] Date of Patent: Nov. 4, 1997

[54] REFINING ELEMENTS

[75] Inventor: Nils Virving, Hässelby, Sweden

[73] Assignee: Sunds Defibrator Industries AB, Sweden

[21] Appl. No.: 793,160

[22] PCT Filed: Jun. 26, 1995

[86] PCT No.: PCT/SE95/00780

§ 371 Date: Feb. 11, 1997

§ 102(e) Date: Feb. 11, 1997

[87] PCT Pub. No.: WO96/05911

PCT Pub. Date: Feb. 29, 1996

[30] Foreign Application Priority Data

Aug. 18, 1994 [SE] Sweden ..... 9402747

[51] Int. Cl.[6] ..... B02C 7/12

[52] U.S. Cl. ..... 241/261.2; 241/261.3; 241/296; 241/297

[58] Field of Search ..... 241/261.2, 261.3, 241/296, 297, 298

[56] References Cited

U.S. PATENT DOCUMENTS

| | | | |
|---|---|---|---|
| 2,654,295 | 10/1953 | Sutherland | 241/261.3 X |
| 3,149,792 | 9/1964 | Textor | 241/261.3 X |
| 4,039,154 | 8/1977 | Peterson | 241/261.3 |
| 4,772,358 | 9/1988 | Virving | 241/261.3 X |
| 5,112,443 | 5/1992 | Virving et al. | 241/261.3 X |
| 5,181,664 | 1/1993 | Kohler | 241/261.3 |
| 5,362,003 | 11/1994 | Virving | 241/261.3 |
| 5,383,617 | 1/1995 | Deuchars | 241/298 |

*Primary Examiner*—John M. Husar

*Attorney, Agent, or Firm*—Lerner, David, Littenberg, Krumholz & Mentlik

[57] ABSTRACT

Refining elements for use in a disk refiner for disintegrating and refining lignocellulose-containing material is disclosed including a pair of opposed refining elements on opposed refining disks which are relatively rotatable with respect to each other, the first and second refining elements including inner, intermediate and outer refining zones including plurralities of alternating bars and grooves extending substantially radially therealong, in which the bars on the inner refining zones on both refining elements extend outwardly at an angle with respect to the radius of the refining elements in different directions, the bars in the intermediate refining zones on both refining elements extend radially outward at an angle of less than about 15° with respect to the radius of the refining elements, and the bars in the outer refining zones on both refining elements extend radially outward at an angle with respect to the radius of the refining element in the same direction with respect thereto.

7 Claims, 1 Drawing Sheet

REFINING ELEMENTS

FIELD OF THE INVENTION

The present invention relates to the disintegration and refining of lignocellulosic material, such as mechanical pulp (TMP, CTMP), reject pulp, recycled fiber pulp and the like in a disk refiner. More precisely, the present invention relates to refining elements for use in a refiner of this type.

BACKGROUND OF THE INVENTION

Known disk refiners comprise two opposed refining disks which rotate relative to each other, one or both of which are thus rotary. A plurality of refining elements are arranged on the refining disks, and include a pattern of bars and intermediate grooves. The refining disks are positioned so that the refining elements form a refining gap therebetween, through which the fiber material is intended to pass outwardly from within, whereby disintegration is carried out by the bars of the refining elements. These bars can be of various designs and, thus, may be continuous or discontinuous, and of uniform of varying height. In certain cases serrated bars can be used.

The fiber material is first defibered in the refining gap between the refining surface, i.e., the fibers are freed, which takes place in the interior portion of the refining gap where the distance between the refining surfaces is the greatest. The refining gap narrows thereafter outwardly so that the desired working of the fiber material is obtained. Large amounts of energy are thus required to bring about this working The material concentration can be between about 3% and 50%, which implies that simultaneously large amounts of steam are generated from the water associated therewith.

The refining surfaces are formed in different ways, depending on the desired degree of working, and thus on the desired pulp quality. The pulp quality is also affected by other factors, for example the size of the refining gap, the liquid content in the fiber material, feed, temperature, etc.

The appearance of the refining surfaces is of great importance, especially with regard to the fiber length of the material so worked. With a substantially radial orientation of the bars on the refining surfaces, a large proportion of long and well fibrillated fibers is obtained in the pulp. This can be explained by the fact that the fiber material orients itself in the refining gap with the fiber in a direction substantially parallel to the far edges. In this manner, defibering and working take place by virtue of the fact that the fiber material substantially rolls between the bars on opposed refining surfaces whereby the fibers are freed and fibrillated along their entire length. This type of pulp obtains high strength, and is therefore particularly valuable for many applications such as for newsprint. The energy consumption during the manufacture of this type of pulp is relatively high.

At an oblique orientation of the bars in relation to the radius, the proportion of long fibers in the pulp decreases, because in this case the bar edges exert a cutting effect on the fiber material. At the same time that the cutting effect increases, the fibrillation effect decreases. The strength properties of this pulp type are certainly lower, but the pulp is particularly suitable for use in the manufacture of fine paper qualities where forming, printability and opacity are appreciated.

The bar angle is also of importance for feeding the material through the refining gap. When the bars are angled obliquely outward rearward with respect to the direction of rotation, an outward pumping action is obtained, while angling in the opposite direction yields a braking effect. The stay time of the material in the refining gap is thus affected by the angle of the bars.

Known refining elements are specifically designed so as to produce desired properties in the pulp. This implies in many cases that compromises must be made with regard to the design of the refining surfaces in order to bring about a suitable balance between fibrillation and cutting of the fibers and, on the other hand, between feeding and braking.

SUMMARY OF THE INVENTION

In accordance with the present invention, these and other objects have now been accomplished by 10 the provision of apparatus for use in a disk refiner for the disintegration and refining of lignocellulose-containing material which comprises a pair of refining disks rotatable relative to each other thereby providing a refining gap for the lignocellulose-containing material therebetween, the apparatus comprising a first refining element disposed on one of the pair of refining disks, and a second refining element disposed on the other of the pair of refining disks facing the first refining element, the first and second refining elements thereby defining corresponding radii, the first refining element including a plurality of refining zones disposed radially outwardly thereon, including an inner refining zone, and intermediate refining zone, and an outer refining zone, the second refining element including a plurality of refining zones disposed radially outwardly thereon and including an inner refining zone at a location corresponding to the inner refining zone on the first refining element, an intermediate refining zone at a location corresponding to the intermediate refining zone on the first refining element, and an outer refining zone at a location corresponding to the outer refining zone of the first refining element, each of the refining zones comprising a plurality of alternating bars and grooves extending substantially radially therealong, the bars on the inner refining zones on the first and second refining elements extending radially outward at an angle with respect to the radius of the refining elements in different directions with respect thereto whereby the bars lie in intersecting planes, the bars in the intermediate refining zones on the first and second refining elements extending radially outward at an angle of less than about 15° with respect to the radius of the refining elements, and the bars on the outer refining zones on the first and second refining elements extending radially outward at an angle with respect to the radius of the refining elements in the same direction with respect thereto.

In accordance with a preferred embodiment of the apparatus of the present invention, the bars on the inner refining zones on the first and second refining elements extend radially outward at an angle of between about 10° and 30° with respect to the radius of the refining element.

In accordance with another embodiment of the apparatus of the present invention, the bars on the outer refining zones on the first and second refining elements extend radially outward at an angle of between about 10° and 30° with respect to the radius of the refining elements.

In accordance with another embodiment of the apparatus of the present invention, the bars on the outer refining zones on the first and second refining elements are substantially parallel to each other.

In accordance with another embodiment of the apparatus of the present invention, the plurality of alternating bars and grooves extending substantially radially along the first and second refining elements in each of the inner, intermediate and outer refining zones include a plurality of substantially parallel extending bars and grooves. In a preferred embodiment, each of the plurality of alternating bars and grooves in each of the inner, intermediate and outer refining zones includes a plurality of groups of the alternating bars and grooves.

In accordance with another embodiment of the apparatus of the present invention, the plurality of bars in at least one of the inner, intermediate and outer refining zones on the first and second refining elements extends radially outward at an angle substantially corresponding to the radius of the refining elements.

In accordance with the present invention, the refining elements can be formed so that they yield an optimum pulp and at the same time minimize the energy consumption. To this end, cooperating reining elements are formed with bars and grooves in a number of restricted zones located radially outside each other where each refining element comprises at least three such zones. According to the invention, the bars in an opposed inner zone on both refining elements are oblique in different directions in relation to the radius of the refining elements (preferably at an angle of between about 10° and 30°), so that the bars on opposed refining elements cross each other. The bars in an intermediate zone are substantially radial (preferably at an angle of <15°, and most preferably of, <10°), and in an outer zone the bars form an angle with the radius in the range of between about 10° and 30° in the same direction. The bars on opposed refining elements can thus be substantially parallel to each other.

The bars can be divided into several radial zones, each comprising one or more groups of bars, where the bars in each such group are substantially parallel to each other. Alternatively, the bars within one zone can form substantially the same angle with the radius. It is also possible to arrange the bars so that their angle with respect to the radius changes successively across the refining surface.

BRIEF DESCRIPTION OF THE DRAWINGS

The invention is described in greater detail in the following detailed description with reference to the Figures, in which.

DETAILED DESCRIPTION

Figure 1:
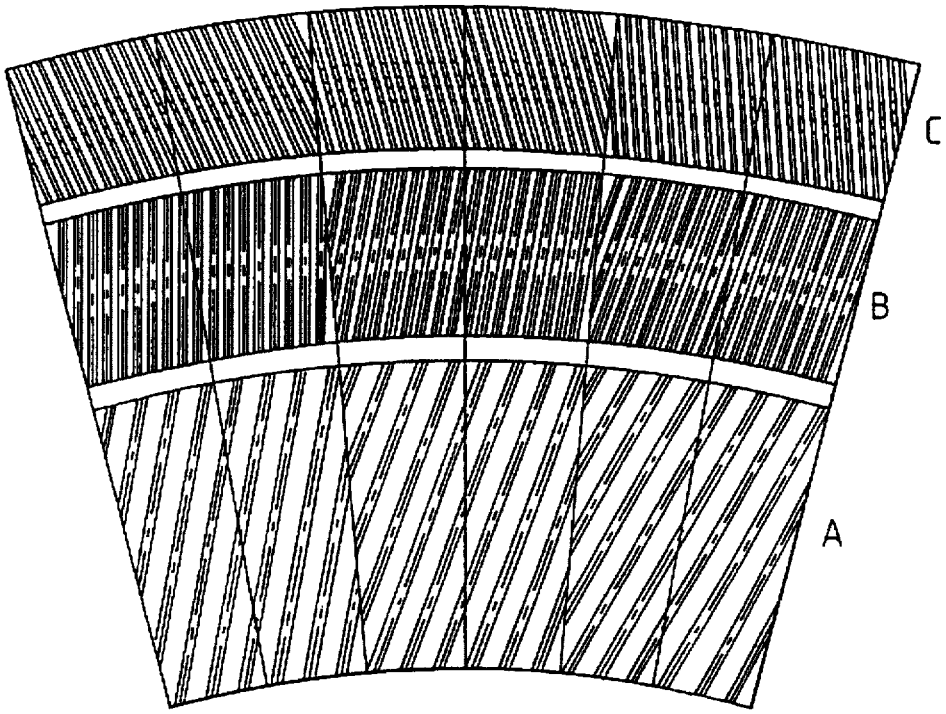
FIG. 1 is a top, elevational, schematic representation of one of the two cooperating refining elements according to the present invention.
Figure 2:
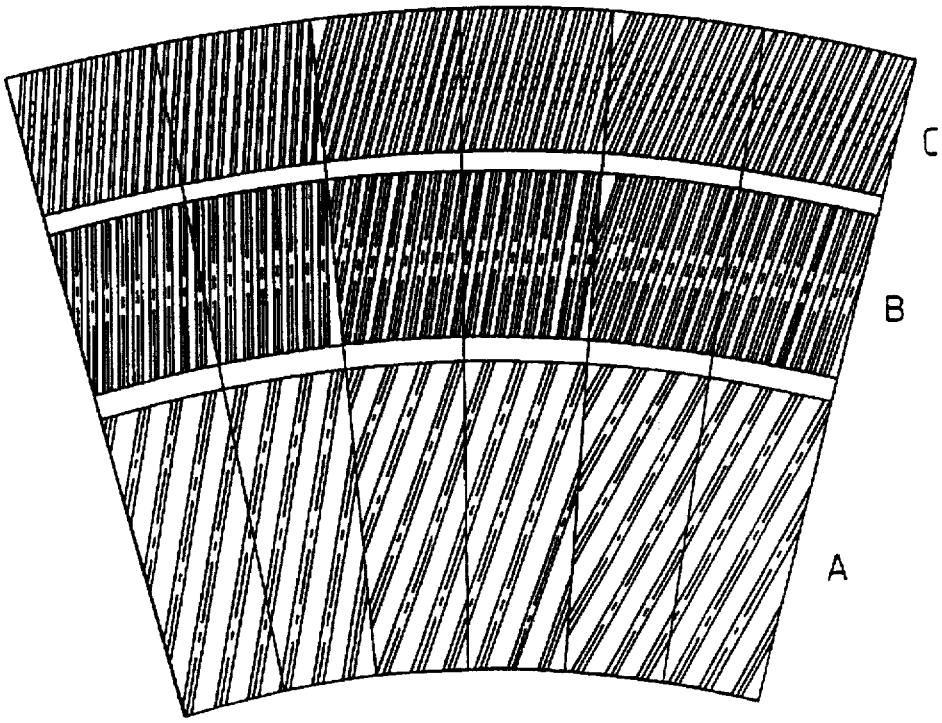
FIG. 2 is a top, elevational, schematic representation of the other of the two cooperating refining elements of the present invention.

The refining surfaces of the cooperating refining elements shown in the Figures, are divided into three zones, where each zone comprises a portion of the radial extension of the refining surface. These include an inner zone A, an intermediate zone B, and an outer zone C. Each zone is provided with bars forming an angle with the radius of the refining element. The bars are arranged in a pattern which tightens (with the spacing between the bars decreasing) radially outward from one zone to another.

The angle in the inner zone A is between about 10° and 30° with respect to the radius. When the refining elements are used in a refiner, the bars are angled for outward feed. In zone A it is desired that feeding take place at the same time as an initial defibering of the material is desired. The refining elements are formed so that the distance between opposed refining elements in the refiner in inner zone A is of such a size that neither cutting nor fibrillation takes place to a significant degree.

The angle in the intermediate zone B is less than about 15°, and preferably less than about 10° C., in relation to the radius. The bars, thus, shall be substantially radial. The distance between opposed refining elements in this zone is sorter, and a certain working of the fibers thus takes place therein. The angle of the bars in this case implies a balancing between feeding and working.

In the outer zone C the final working of the fibers takes place. The angle of the bars in relation to the radius can in this case vary between about 10° and 30°, and the bars on opposed refining elements are directed in the same direction in relation to the radius. The bars in this case can be substantially parallel. In view thereof, the fibrillation effectively increases and the cutting effectively decreases, while at the same time the stay or residence time is extended due to the fact that the bars on one refining element counteract the feed.

All of the above, taken together, results in effective working, such that a desired pulp quality can be obtained at a lower energy input. Full size tests, for example, have shown that the engine load could be lowered from 10.5 MW to 9 MW, while maintaining pulp quality.

The bars in each zone A, B and, C can form one or more groups in which the bars within each group are mutually parallel to each other.

Instead of dividing the refining surface into three radial zones, more zones can be arranged. It is also possible to change the bar angle successively along the refining surface. The bars can thus be either straight or arched.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

I claim:

1. Apparatus for use in a disk refiner for the disintegration and refining of lignocellulose containing material comprising a pair of refining disks rotatable relative to each other thereby providing a refining gap for said lignocellulose containing material therebetween, said apparatus comprising a first refining element disposed on one of said pair of refining disks, and a second refining element disposed on the other of said pair of refining disks facing said first refining element, said first and second refining elements thereby defining corresponding radii, said first refining element including a plurality of refining zones disposed radially outwardly thereon, including an inner refining zone, an intermediate refining zone, and an outer refining zone, said second refining element including a plurality of refining zones disposed radially outwardly thereon including an inner refining zone at a location corresponding to said inner refining zone on said first refining element, an intermediate refining zone at a location corresponding to said intermediate refining zone on said first refining element, and an outer refining zone at a location corresponding to said outer refining zone on said first refining element, each of said refining zones comprising a plurality of alternating bars and grooves extending substantially radially therealong, said bars on said inner refining zones on said first and second refining elements extending radially outward at an angle with respect to the radius of said refining elements in different directions with respect thereto whereby said bars lie in intersecting planes, said bars in said intermediate refining zones on said first and second refining elements extending radially outward at an angle of less than about 15 degrees with respect to the radius of said refining elements, and said bars on said outer refining zones on said first and second refining elements extending radially outward at an angle with respect to the radius of said refining elements in the same direction with respect thereto.

2. The apparatus of claim 1, wherein said bars on said inner refining zones on said first and second refining elements extend radially outward at an angle of between about 10° and 30° with respect to the radius of said refining elements.

3. The apparatus of claim 1 wherein said bars on said outer refining zones on said first and second refining elements extend radially outward at an angle of between about 10° and 30° with respect to the radius of said refining elements.

4. The apparatus of claim 1, wherein said bars on said outer refining zones on said first and second refining elements are substantially parallel to each other.

5. The apparatus of claim 1, wherein said plurality of alternating bars and grooves extending substantially radially along said first and second refining elements in each of said inner, intermediate and outer refining zones include a plurality of substantially parallel extending bars and grooves.

6. The apparatus of claim 5, wherein each of said plurality of alternating bars and grooves in each of said inner, intermediate and outer refining zones includes a plurality of groups of said alternating bars and grooves.

7. The apparatus of claim 1 wherein said plurality of bars in at least one of said inner, intermediate and outer refining zones on said first and second refining elements extends radially outward at an angle substantially corresponding to said radius of said refining elements.

* * * * *